United States Patent [19]

Hachadoorian et al.

[11] 4,019,977

[45] Apr. 26, 1977

[54] DEMISTER-COALESCER IN A PROCESS FOR REMOVING WATER FROM OIL

[75] Inventors: Robert Haig Hachadoorian, Great Neck; Mark Lincoln Shyman, Kings Park, both of N.Y.

[73] Assignee: Aquanetics, Inc., Long Island, N.Y.

[22] Filed: Apr. 30, 1975

[21] Appl. No.: 573,354

Related U.S. Application Data

[63] Continuation-in-part of Ser. No. 505,977, Sept. 16, 1974, abandoned.

[52] U.S. Cl. ..... 208/188

[51] Int. Cl.[2] ..... C10G 33/06

[58] Field of Search ..... 208/187, 188

[56] References Cited

UNITED STATES PATENTS

| | | | |
|---|---|---|---|
| 2,062,934 | 12/1936 | Renfrew | 208/187 |
| 2,689,875 | 9/1954 | Hachmuth et al. | 208/187 |
| 3,448,038 | 6/1969 | Pall et al. | 208/187 |
| 3,453,205 | 7/1969 | Francis, Jr. et al. | 208/188 |

*Primary Examiner*—George Crasanakis
*Attorney, Agent, or Firm*—Kenyon & Kenyon Reilly Carr & Chapin

[57] ABSTRACT

An oil reclamation process wherein oil containing liquid contaminants, principally water, in both a free and dissolved state is passed through a vessel maintained under vacuum where it passes over a dispersing material to increase its surface area and such exposure to vacuum within the vessel increases the vapor pressure of the water contained in the oil such that steam is generated through evaporation, the decontaminated oil and the steam generated then being separately removed from the vessel where the steam is then condensed and the water so produced is discharged to waste.

1 Claim, 1 Drawing Figure

DEMISTER-COALESCER IN A PROCESS FOR REMOVING WATER FROM OIL

Figure 1:
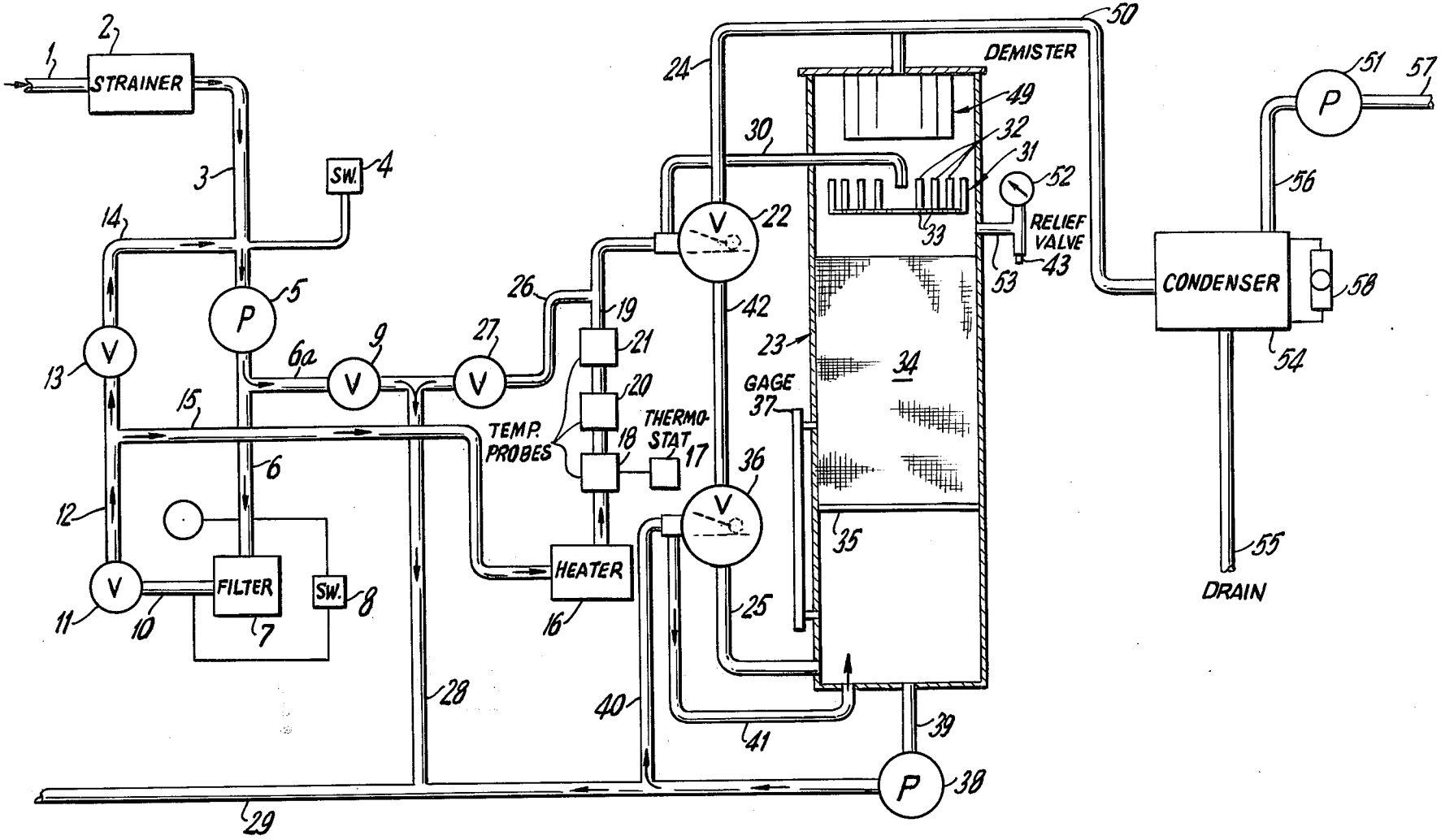

This application is a continuation-in-part of our copending application Ser. No. 505,977, filed Sept. 16, 1974, now abandoned.

BACKGROUND OF THE INVENTION

This invention relates to the purification and reclamation of oils of various types. It is particularly concerned with the removal of water from oils.

It is generally agreed that oil nevers wears out mechanically. The lubricating quality of oil is inherent in the oil, and truly clean oil can be used indefinitely. As long as dilution by liquid contaminants (such as water and acids), gaseous contaminants (such as air) and particulate contaminants (such as dirt, metals, bacteria and other suspended solids) is prevented, the original properties of the oil are maintained. Oil degradation is generally caused by oil containing any one, or a combination, of the above contaminants. Of these contaminants, one of the hardest to eliminate is water since particulate contaminants are generally satisfactorily removed by filtration methods whereas water is not.

Water exists in oil in two phases, as water in solution with the oil (dissolved oil) and as free water which is either separated from the oil or emulsified with the oil. The presence of water in solution in an oil is undetectable by visual means, since it is not present in the form of droplets. Free water present in an oil exists as droplets suspended in the oil. These droplets are often so fine and so well dispersed that, on casual observation, the oil appears to be clear. However, above certain levels, the oil is no longer clear, and the presence of water in these quantities is easily detected by visually observing its cloudy, muddy appearance. The state of dispersion of free water in oil varies dependent upon the additives present in the oil. High grade lubricating and hydraulic oils contain anti-corrosion and anti-wear additives which tend to maintain the water as a stable dispersion, of very fine droplets.

The presence of this water in oil renders the oil unsatisfactory for use because free water present in oil often tends to collect in low spots and dead spots in equipment and causes serious corrosion problems. In addition, water in oil is conducive to oil breakdown by chemical oxidation, with consequent acid formation. Oil with the absence of waer, even when exposed under oxidizing conditions at high temperature, shows a substantially reduced tendency to form organic acids which can be extremely corrosive. Further, water in oil can promote the polymerization of oil to form larger long chain molecules, which in turn cause viscosity change and generation of solids (gums, tars, etc.) harmful in terms of clogging orifices, and causing abrasive wear.

Many systems have been utilized in an attempt to purify and reclaim oil. These include centrifuges, coalescers, filtration units and vacuum distillers. However, none of these systems have been effective in providing a continuous process for removing both free and dissolved water and other impurities from oil in an efficient and economical manner.

For example, one system similar to that of the present invention is that disclosed in U.S. Pat. No. 3,561,193. That system, like the present invention, removes water from oil through a vacuum distillation procedure. However, the system disclosed in that patent is deficient in that the vacuum distiller is only capable of removing the water dissolved in the oil. It is not capable of removing the free water during the distillation process and thus the free water must be removed separately, through the use of filters before the oil even reaches the distiller. This makes the equipment more cumbersome and slows down the process in that one using this process must be sure that all the free water is removed before the oil reaches the distiller.

In addition, in the system disclosed in U.S. Pat. No. 3,561,193, the water which is removed from the oil in the distiller is removed from the system directly through the vacuum line and pump. This necessitates using a relatively large capacity vacuum pump and also presents the risk that the water will accumulate in and damage the vacuum pump.

It is therefore an object of the present invention to remove virtually all the water, both free and dissolved, from oil during the distillation procedure without the need of extra filter elements to remove the free water.

It is a further object of the present invention to remove virtually all the water, both free and dissolved, from oil through the use of a considerably smaller capacity vacuum pump and with a minimum danger of damage to said pump than has been heretofore possible.

SUMMARY OF THE INVENTION

The present invention removes both free and dissolved water from oil by a diffusional separation process wherein oil containing water in both the free and dissolved state is introduced into a vessel. This vessel is under a high enough vacuum such that the vapor pressure of the water is greater than the total pressure in the vessel. The water contained in the oil diffuses though the oil and its state is changed from that of a liquid to that of a vapor (i.e., saturated steam under these temperature and pressure conditions) due to the fact that the water vapor pressure is greater than the total pressure. The steam generated in this fashion is removed from the vessel thereafter to be condensed, and such condensate produced to be drained from the system to waste. Normally the change of state described above occurs very slowly, unless means are used to increase the speed of this change of phase. We have found that the variables principally involved in increasing the rate of state change when dealing with an oil-water mixture are:

1. Surface area of the oil-water mixture exposed to the temperature pressure conditions that produces the state change within the vacuum vessel. The higher the surface area the more oil-water exposed, hence, the greater the change of phase.

2. Time duration (contact time) that this mixture is exposed within the vacuum vessel, i.e., rate of flow. The lower the flow rate the higher the contact time and the higher the rate of state change.

3. The level of vacuum (i.e., the total pressure within the vessel) below the vapor pressure of the water in the oil entering the vessel. The lower the total pressure the faster the rate of phase change occurs.

4. The level of temperature within the vessel. The higher the temperature of the oil-water mixture the higher the vapor pressure of the water within the oil, and the faster the rate of phase change.

5. Viscosity of the oil. The lower the oils viscosity the thinner a surface area film can be developed which in turn increases the exposure time of the water in the oil to the low pressure condition and increases the rate of phase change.

The present invention maximizes the removal of both free and dissolved water from oil without creating conditions potentially harmful to the oil being reclaimed through the optimum choice of the variables described above while avoiding the use of excessive temperatures. The invention removes water by allowing the oil to flow downward over a material designed to provide the oil with an extremely high surface area, and which effects a constant exchange of oil-water surfaces. These oil-water surfaces areas expose a maximum amount of water within the oil to the low total pressure within the vessel such that the phase change previously described can take place. Through the optimization of the variables discussed above, the present invention permits both free and dissolved water to be efficiently removed within the vessel thus eliminating the need for removing the free water by external filters as was necessary in the prior art systems. In addition, by condensing the steam after it leaves the vessel, the present invention is capable of efficient operation with much smaller capacity vacuum pump than those of the prior art while at the same time minimizing the danger of damage to the vacuum pump from water corrosion.

DESCRIPTION OF THE INVENTION

These and other advantages of the present invention will appear from the following description and drawings wherein:

FIG. 1 shows a schematic representation of the process of the present invention.

With respect to the flow diagram, illustrated in FIG. 1, there is shown an inlet line 1 having an inlet strainer 2. The liquid passes through inlet strainer 2 which removes fairly large size solid contaminants. A motorized inlet pump 5 is connected to the strainer through line 3. Clogging of the inlet strainer 2 is sensed by a vacuum switch 4 sensing vacuum pressure in line 3. Inlet pump 5 is protected by a by-pass relief valve 9 which is set at 130 P.S.I. A filter 7 is connected to the pump 5 by line 6. The filter 7 contains filter elements and serves to remove 100% of all particulates 2 microns and larger and 99% of all particulates 0.3 microns and larger. The filter elements so constructed are of a stainless steel fibrous mat material with extremely high porosity and as such are cleanable by a simple back-flushing procedure. Clogging of the filter elements is sensed by a two-point differential pressure switch 8 set at 90 P.S.I. and 110 P.S.I., respectively.

As the filter element clogs, the differential pressure will rise and at 90 Psid the switch will activate a red light on a separate control panel (not shown) indicating that the filter element within filter 7 needs to be changed. If the filter element is not removed and continues to collect particulates such that the differential pressure exceeds 110 Psid, the second set point of differential pressure switch 8 set at 110 Psid actuates relays (not shown) in the control panel (not shown) such that the entire system shuts down. The red light with legend "change filter" remains lit to indicate cause of shutdown and remedy. If differential pressure switch 8 fails to operate, filter 7 will be protected by fluid flowing through line *6a* to relief valve 9.

After passing through filter 7, liquid flows through line 10 to check valve 11 and then to a branch in line 12. One branch contains adjustable, temperature and pressure compensated, flow control valve 13 regulated to permit a small amount of liquid to return through line 14 to inlet pump 5. This permits the regulation of total system liquid throughput. The balance of liquid flow in line 12 will continue through line 15 and will be introduced into heater 16 which is of the low watt density type to protect the liquid from deterioration as a result of the exposure to the heater. Heater 16 is controlled by an adjustable thermostat 17 adjusted between 130° and 140° F and regulated by liquid temperature probe 18 in line 19 downstream of heater 16. Liquid temperature is monitored by a remote, panel mounted, temperature gage (not shown) in control panel (not shown) connected by a capillary tube to temperature probe 20 in line 19. Liquid overtemperature safety is provided by high oil temperature switch (not shown) set at 180° F connected by a capillary to high oil temperature probe 21 in line 19. If the high oil temperature switch is activated, system shutdown occurs electrically and a red light with high oil temperature legend on the control panel (not shown) is also activated indicating the cause of shutdown.

Following passage through heater16 and controls as described, liquid flows through line 19 to float operated level control valve 22 and continues through line 30 to enter column 23. In the event liquid level in column 23 rises so high as to close level control valve 22, sensing liquid level through external balancing lines 24 and 25, then liquid will seek escape through point of least resistance, relief valve 27 in line 26 set at 75 psi. Such liquid, prevented from entering column 23 due to an excessive level will continue to seek egress through lines 26 and 28. In that line 26 is provided with unidirectional flow relief valve 27, liquid must flow through line 28 joining with line 29 to be discharged from the system until high level condition in column 23 is relieved.

Liquid enters column 23 through line 30 when float valve 22 is open. Liquid is introduced into distributor pan 31 through line 30. The distributor pan 31 contains a series of large diameter risers 32 and small diameter holes 33, sized and located by an elaborate system of calculations derived for the express purpose of optimizing liquid-gas distribution. Liquid passes through the holes in distributor pan 31 and falls onto a packed material 34 of knit-mesh construction substantially as illustrated in U.S. Pat. No. 3,218,048 and selected and arranged in a density gradient ranging from the coarsest at the top to the finest at the bottom. The purpose of the packing is not only to provide a high surface area to the oil-water mixture, but also to aid in the separation of the water from the oil. For example in the present embodiment a water dispersion is to be separated from oil. Therefore a high surface energy material should be used such as metal or metal oxide to maximize separation. The high surface energy material causes a preferential wetting of the material by the water to that of the oil. As the preferential wetting occurs a film of water will be formed on the material which will build up large water droplets on the packing. The packing chosen for the column therefore is constructed of a metallic multi-strand knitted mesh designed to aid in the separation of the two liquids, i.e., oil and water, such that the water droplets formed can more readily vaporize into steam by the method previously described. Thus, by utilizing this packing material, both free and dissolved water are readily exposed to the vacuum within the vessel where they both are converted to steam and removed from the oil. The packing is supported from below by a grate type support plate 35 which is welded to the inside wall of column 23 at a location above that of the set point of low level float valve 36. The level of the liquid in the column is sensed by a level gage 37. The liquid in the column is pulled from it by a motorized pump 38 connected to the column by line 39 which pumps the liquid out of the system through line 29. A small amount of the liquid is permitted to flow to externally mounted low level float valve 36 through branch line 40. Float valve 36 holds the low level in column 23 in the following manner: if the level is high, the float is high, therefore the valve is held closed, and the liquid discharged from motorized pump 38 must exit from the system through line 29. If liquid level falls, the float will follow, opening the valve mechanically, therefore permitting a variable amount of liquid to re-enter the bottom of the column 23 through line 41. External low level float valve 36 senses liquid level in column 23 through line 25. It is balanced to the vacuum environment in column 23 through line 42 which is linked to line 24 through high level float valve 22.

Motorized pump 38 may have difficulty pulling liquid from column 23 under certain excessive vacuum conditions. Therefore, control of the vacuum in column 23 is modulated by a mechanical vacuum relief valve 43, connected to column 23 by line 53. As relief valve 43 opens, vacuum is reduced allowing motorized pump 38 to pull liquid from column 23 under more favorable vacuum conditions.

Removal of water from the oil is accomplished by the fact that at a specific temperature water has a specific vapor pressure. If the absolute pressure surrounding an oil-water mixture is lower than the vapor pressure of the water, then the water will vaporize into saturated steam. For example at 120° F water has a vapor pressure of 3,448 inches of mercury. If a vacuum of 27 inches of mercury is pulled the absolute pressure will be 2.912 inches of mercury. The vacuum pulled therefore produces a pressure that is lower than the vapor pressure of the water so that the water vaporizes into steam. Thus by passing the oil-water mixture into the column containing the packing the mixture tends to travel down over the packing producing a very high surface area. If the temperature and pressure in the column are maintained as in the above example the steam thus generated will be pulled toward the top of the column. The higher the surface area of the packing material the more water that will be exposed to the low pressure, and thus the more steam that will be produced. The lower the total pressure in the column the greater the speed of phase change and more steam can be produced.

The lower the rate of flow of the oil-water mixture the longer the residence time of the oil-water mixture within the column, and consequently the more that water can be vaporized into steam and the less water the existing oil will contain.

After removal from the vessel, the steam passes through the barrier of demister-coalescer 49 and exits the column 23 at line 50 still under the effect of the vacuum condition established by vacuum pump 51. The demister-coalescer is designed to prevent the carry-over of any liquid oil droplets out of the column 23 by a combination of coalescing and demisting the oil droplets and mist. Contrary to the packing in the tower which separates and disperses the water from the oil and therefore is a high surface energy material, the packing in the demister-coalescer must separate and dispense oil droplets from the water and thus uses a low surface energy material such as an organic polymeric material-polypropylene, nylon, etc. to enhance separation. The material chosen for the demister-coalescer 49 at the top of the column therefore is constructed of a polypropylene multi-strand knitted mesh so that the oil vapor and droplets will preferentially wet the material and not be carried out of the column with the steam.

Vacuum level in column 23 is sensed by vacuum gage 52 mounted connected to column 23 by line 53.

Saturated steam which has exited column 23 through line 50 then enters condenser system 54 through line 50. The condenser system 54 serves to condense the steam, the condensate then being periodically removed from the condenser through drain 55 and thereafter discarded. An added advantage of the condenser is to reduce the volume of steam so that the capacity requirements of the vacuum pump removing steam from the system are correspondingly substantially reduced. Also, by condensing the steam before it reaches the vacuum pump, the possibility of the steam condensing in the vacuum pump is precluded thus assuring that unwanted water doesn't reside in the pump where it can cause harm to the pump's working parts.

The condenser can be any of many types, such as refrigeration type, water cooled, or air cooled. In the preferred embodiment (in order to make the equipment portable) an air cooled condenser is utilized. Therefore the temperature of the steam exiting the column and entering the condenser must be sufficiently greater than that of the ambient air temperature so that when air is used for cooling, condensation can take place.

Maintaining the oil-water mixture entering the column at a temperature of 20° to 25° F. greater than that of the ambient air temperature has been found to be a sufficient temperture difference to utilize air cooling for condensation.

Use of the condenser increases the rate of phase change in the column as follows. Condensation of the steam in the condenser produces a partial vacuum by reason of the great reduction in the volume of the low pressure vapor. A pound of dry steam at a vacuum of 6 inches of mercury absolute (2.89 psia) has a volume of 123 cu feet. Theoretically, if this quantity were contained in a steam-tight vessel of 123 cubic feet volume at an absolute pressure of 6 inches of mercury and if condensation into water occurred at 110° F, the liquid would occupy only 0.01617 cu feet. The volume would be 1/7607 of the space inside the vessel and the pressure would fall to 0.881 inches of mercury absolute (0.43 psia).

Utilization of this principle within the present embodiment enables the use of a vacuum pump that only has to pull a vacuum high enough to initiate the start of the process. Once the process is initiated and condensation begins to occur the vacuum increases due to the additional vacuum created by the condenser thus increasing the rate of phase change in the column.

After the steam is condensed by condenser 54, any air and other non-condensable vapors removed from the oil, leave the condenser through line 56, pass through vacuum pump 51 and leave the system through vacuum pump exhaust line 57.

Should condenser system 54 malfunction in any way such that condensate accumulates to a high level, a contact actuates a relay causing total system shutdown and a red light with legend "Condenser Overloaded" (not shown) indicates cause of shutdown.

What is claimed is:

1. In a process for removing water from oil by passing a mixture of oil having both free and dissolved water contained therein over a dispersing material contained in a vessel and subjecting said dispersed mixture within said vessel to pressure lower than the vapor pressure of the water within said mixture whereby said water is vaporized into vapor, the improvement which comprises, passing said vapor through demisting-coalescing means having low surface energy material which is preferentially wetted by oil to coalesce and separate oil droplets from said vapor.

* * * * *